US006079222A

United States Patent [19]

Fetescu et al.

[11] Patent Number: 6,079,222

[45] Date of Patent: Jun. 27, 2000

[54] METHOD FOR PREPARING DEEP-FROZEN LIQUID GAS

[75] Inventors: Mircea Fetescu, Ennetbaden, Switzerland; Lutz Löwel, Bad Säckingen, Germany

[73] Assignee: Asea Brown Boveri AG, Baden, Switzerland

[21] Appl. No.: 09/040,463

[22] Filed: Mar. 18, 1998

[30] Foreign Application Priority Data

Apr. 24, 1997 [DE] Germany ..... 197 17 267

[51] Int. Cl.[7] ..... F25J 1/00

[52] U.S. Cl. ..... 62/601; 62/54.2; 62/915

[58] Field of Search ..... 62/54.2, 913, 601

[56] References Cited

U.S. PATENT DOCUMENTS

| | | | |
|---|---|---|---|
| 3,720,057 | 3/1973 | Arenson | 60/39.02 |
| 3,726,085 | 4/1973 | Arenson | 60/39.02 |
| 4,315,407 | 2/1982 | Creed et al. | 62/50.2 |
| 4,329,842 | 5/1982 | Hoskinson | 62/50.2 |
| 5,147,005 | 9/1992 | Haeggstrom | 180/69.5 |

FOREIGN PATENT DOCUMENTS

| | | |
|---|---|---|
| 0001392A1 | 4/1979 | European Pat. Off. . |
| 1988638 | 7/1968 | Germany . |
| 2716663 | 10/1978 | Germany . |
| 4326138C2 | 2/1995 | Germany . |

OTHER PUBLICATIONS

"Refrigerated inlet cooling for new and retrofit installations", Gas Turbine World, vol. 23, No. 3, May–Jun. 1993.

"LPG/LNG Receiving Terminals", Chiyoda technical publication [no date].

*Primary Examiner*—Ronald Capossela
*Attorney, Agent, or Firm*—Burns, Doane, Swecker & Mathis, L.L.P.

[57] ABSTRACT

The object of the invention is to provide a method for preparing deep-frozen liquid gas for the purpose of recovering process energy for a downstream process, with which the refrigerating capacity of the deep-frozen liquid gas can also be used in the downstream process. According to the invention, this is achieved by the fact that the refrigerating capacity of the deep-frozen liquid gas (1) is fed as a heat sink to at least one of the part-steps of the downstream process via at least one heat-exchange medium (28, 54, 79) and, if said heat-exchange medium (28, 54, 79) is not available, the deep-frozen liquid gas (1) is regasified with an additional heat-exchange medium (32).

8 Claims, 3 Drawing Sheets

5
36
69
37
38
56
62
61
64
65
29
44
45
25
47
28
4
24
52
51
54'
50
48
49,
40
46
43
42
41
14
13
10
3
1
2
16
17
6
39
63
70
66
67
27
35
54
29"
29'
20
53
55
68
58
57
59
49
60

METHOD FOR PREPARING DEEP-FROZEN LIQUID GAS

BACKGROUND OF THE INVENTION

1. Field of the Invention

The invention relates to a method for preparing deep-frozen liquid gas, such as for example liquefied natural gas (LNG) or liquefied propane gas (LPG) or even industrial gases, for a downstream technical process.

2. Discussion of Background

In addition to crude oil and its products produced by cracking and coal, nowadays gaseous energy carriers, such as for example natural gas and propane gas, are also used as fuels for power stations or in processes of the steel and chemical industry. Since gases generally have a relatively large volume, they must be sufficiently compressed in order to implement effective transportation and effective storage. Since, however, far more energy is required for the compression of gases than for the compression of liquids, the natural gas and the propane gas are first liquefied. In the process, so-called liquefied natural gas (LNG) or liquefied propane gas (LPG) is obtained. Both transportation and storage of these liquid gases are carried out under atmospheric pressure and at temperatures of about minus 160° C. Accordingly, the respective deep-frozen liquid gas must be vaporized, i.e. regasified, before it is used as fuel.

According to page 9 of the brochure 100-332 2 MCI of the company CHIODA, printed in May 1995 in Japan, under the title "CHIODA in LPG/LNG receiving terminals", a number of evaporation devices are known for each of the deep-frozen liquid gases used, in which devices the energy required to vaporize the low-temperature fuel is supplied in the form of hot water, seawater or additional fuel. After the quantity of heat required for the evaporation operation has been given off, the respective heat-exchange medium is conducted away again, as a result of which its refrigerating capacity is lost from the process.

In contrast, cooling is required in many subprocesses in power stations and in the steel and chemical industry. According to the article "Refrigerated inlet cooling for new and retrofit installations" in the journal Gas Turbine World, Volume 23, No. 3, of May/June 1993, the lowering of the air inlet temperature of a gas turbine plant, i.e. the inlet temperature of the combustion air sucked in by the compressor, leads to a considerable improvement in the power given off and the heat consumption. External coolants, such as stored ice, ammonia, freons, glycol, etc., are used for this purpose. However, the provision, the handling and the environmentally compatible disposal of these additional coolants causes considerable effort and thus costs.

SUMMARY OF THE INVENTION

Accordingly, one object of the invention is to avoid all these disadvantages and to provide a novel method of preparing deep-frozen liquid gas for the purpose of recovering process energy for a downstream technical process, with which the refrigerating capacity of the deep-frozen liquid gas can also be used in the downstream technical process.

According to the invention, this is achieved in that, in a method according to the preamble of claim 1, the refrigerating capacity of the deep-frozen liquid gas is fed as a heat sink to at least one of the part-steps of the downstream technical process via at least one heat-exchange medium. With this method, the refrigerating capacity of the deep-frozen liquid gas transferred to the heat-exchange medium can be used in the downstream process, and the use of external heat-exchange media, together with the disadvantages they entail, is therefore reduced considerably. If this heat-exchange medium is not available, the deep-frozen liquid gas is regasified with an additional heat-exchange medium. This step of the method serves primarily to start up the downstream technical process and it is likewise activated if the first heat-exchange medium is otherwise not available, such as for example in the case of repair work. Considered separately, it resembles the conventional method in which the heat-exchange medium is conducted away out of the process without being used after the deep-frozen liquid gas has been regasified.

To implement this step of the method, it is particularly expedient for the deep-frozen liquid gas firstly to be subdivided into two part-flows, for the first part-flow to be heated with an external heat-exchange medium, regasified, then ignited and burnt with formation of the additional heat-exchange medium. Finally, the second part-flow of the branched-off deep-frozen liquid gas is regasified in the heat exchange with the additionally formed heat-exchange medium, thus ensuring that the downstream technical process is provided with the required gaseous medium at all times.

In general, this solution can be used for processes in energy supply (power stations, energy distribution) in the steel industry or the chemical industry, in which deep-frozen liquid gases, such as LNG or LPG or industrial gases (e.g. $N_2$, $O_2$, $NH_3$, etc.) have to be vaporized, and in which there is the requirement of process cooling at the same time.

It is particularly advantageous for a working medium of the process downstream of the regasification to be used as the first heat-exchange medium and for this working medium to be cooled in the direct heat exchange with the deep-frozen liquid gas. In a first embodiment of the invention, fuel which has been converted by means of the regasification from the liquid state to the gaseous aggregate state is finally fed to a gas turbine process, is burnt there to form a smoke gas and the latter is expanded for the purpose of work output. In this case, ambient air to be compressed in the gas turbine process is used as the first heat-exchange medium.

The lowering of the air inlet temperature of the compressor involved in this process leads to a considerable improvement in the power given off and the heat consumption in the gas turbine process. Since, when the deep-frozen liquid gas is used as a cooling medium for the ambient air to be sucked in, no additional energy is required for the provision of an external coolant, the energy consumption of the gas turbine process can be lowered despite the higher capacity. In addition to the costs for external coolants, the environmental pollution associated with their use is also dispensed with.

Furthermore, it is advantageous for a second heat exchange of the deep-frozen liquid gas to take place with a second heat-exchange medium in addition to the first one. Subsequently, each heat-exchange medium is fed to a separate part-step of the downstream process. In this case, regasified, gaseous fuel is introduced into a gas turbine process, is burnt there to form a smoke gas, and the latter is expanded for the purpose of work output. Ambient air to be compressed in the gas turbine process is likewise used as the first heat-exchange medium. The second heat-exchange medium is used as a heat sink of a steam turbine process connected to the gas turbine process.

This solution is suitable, in particular, for cases in which the deep-frozen liquid gas has a refrigerating potential which cannot be fully used by the refrigerating capacity of the first heat-exchange medium. By using the second heat-exchange medium as a heat sink of the steam turbine process, the cooling outlay provided for this subprocess can be reduced considerably. The higher number of switching possibilities causes an increase in both the variability of the overall process and in the number of possible users of the refrigerating potential of the deep-frozen liquid gas. As a result of the division of the evaporation process into two process steps and the consequential, at least partial, spatial separation of the evaporating operation of the deep-frozen liquid gas from the cooling operation of the ambient air sucked in, the explosion protection of the gas turbine plant is improved.

It is particularly advantageous in this solution for water to be used as the second heat-exchange medium. In this case, the temperature of said water is lowered to virtually 0° C. in the heat exchange with the deep-frozen liquid gas, and the water is converted to ice water. At the same time, a turbulent flow is generated in the ice water.

By using water as the second heat-exchange medium and lowering the temperature of the water down to freezing point, the ice water produces a heat-exchange medium which advantageously ensures a high degree of heat transmission during the heat exchange with the ambient air to be compressed in the gas turbine process. In this case, the turbulent flow of the ice water ensures that the ice does not settle in the piping of the closed cooling water system. Moreover, when water is used, the use of coolants such as ammonia, freons, glycol, etc., can be dispensed with, which not only increases the safety of the overall process, but is also better for the environment.

When adding an additive, the temperature of said water can be lowered further in the heat exchange with the deep-frozen liquid gas without the risk of the corresponding piping becoming iced. As a result, a far larger proportion of the refrigerating potential of the deep-frozen liquid gas can be used for the cooling of the downstream process.

According to a second embodiment of the invention, a working medium of the process downstream of the regasification of the deep-frozen liquid gas is used as the heat sink of at least one of the part-steps of the said downstream process. Said working medium being cooled beforehand in the heat exchange with a first heat-exchange medium and, after said heat exchange, the latter being recirculated for heat exchange with the deep-frozen liquid gas. Fuel which has been converted by means of the regasification from the liquid state to the gaseous aggregate state is fed to a gas turbine process, is burnt there to form a smoke gas and the latter is expanded for the purpose of the output. As in the first embodiment, in this case ambient air to be compressed in the gas turbine process is used as the working medium to be cooled. The complete separation of the evaporation of the deep-frozen liquid gas from the cooling operation of the ambient air sucked in enables the explosion protection of the gas turbine plant to be improved considerably in the event of leakages.

Finally, in this embodiment of the invention, water is used as the first heat-exchange medium. In the process, the temperature of said water is lowered to virtually 0° C. in the heat exchange with the deep-frozen liquid gas, and the water is converted to ice water. At the same time, a turbulent flow is generated in the ice water. The advantages associated with this process correspond to those of the first embodiment of the invention.

In analogy to the first embodiment, when adding an additive, the temperature of said water can be lowered further in the heat exchange with the deep-frozen liquid gas without the risk of the corresponding piping becoming iced. As a result, a far larger proportion of the refrigerating potential of the deep-frozen liquid gas can likewise be used for the cooling of the downstream process.

BRIEF DESCRIPTION OF THE DRAWINGS

A more complete appreciation of the invention and many of the attendant advantages thereof will be readily obtained as the same becomes better understood by reference to the following detailed description of two exemplary embodiments of the invention based on a plant for preparing deep-frozen liquid gas for a downstream technical process, when considered in connection with the accompanying drawings, wherein.

Only the elements which are essential for understanding the invention are shown. For instance, the water/vapour circuit, i.e. the flow path of the corresponding working medium downstream of the gas and the steam turbine serving as a connection between the gas turbine plant and the steam turbine is not shown. The flow direction of the working medium is indicated by means of arrows.

DESCRIPTION OF THE PREFERRED EMBODIMENTS

Figure 1:
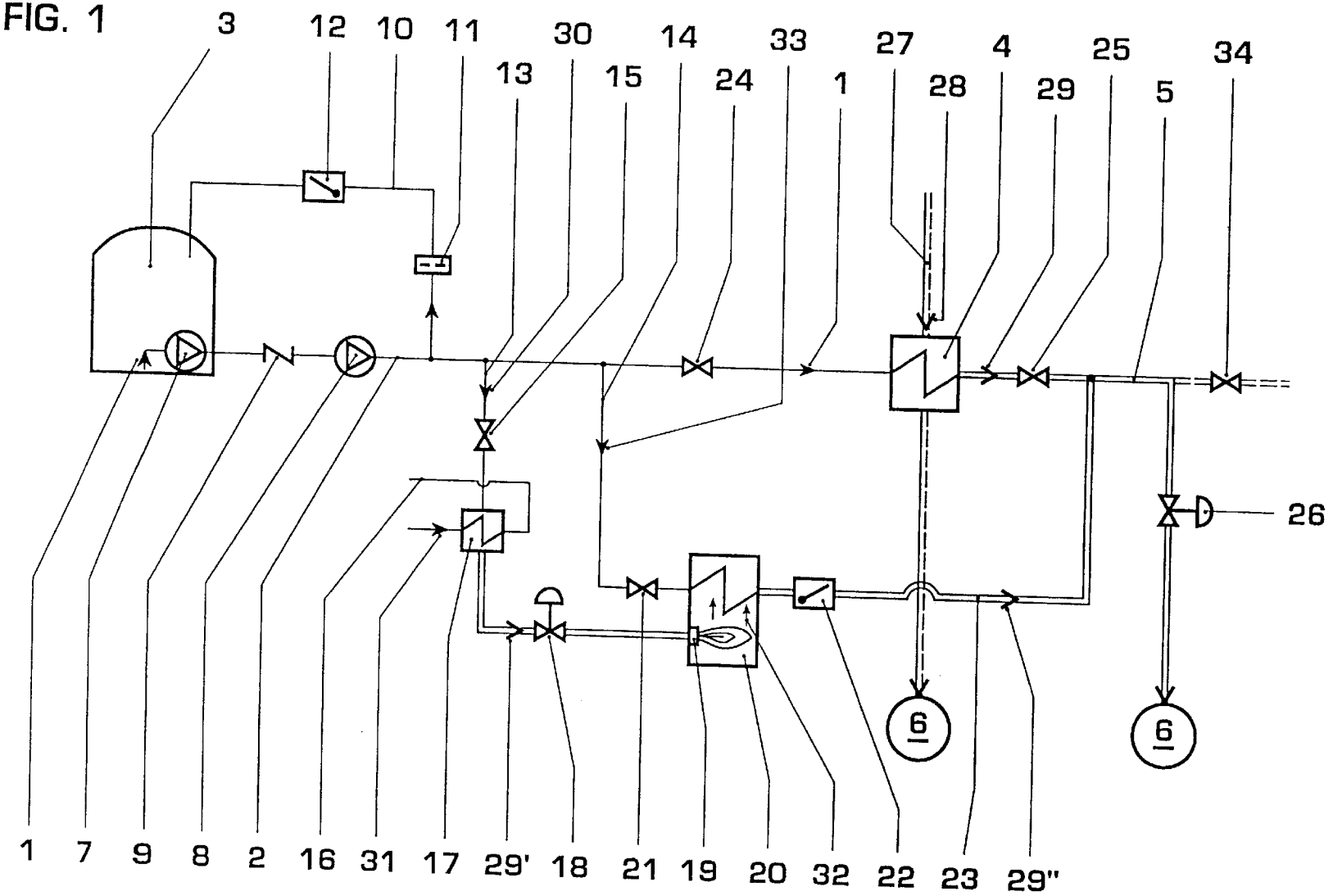
FIG. 1 shows a diagrammatic illustration of the treatment plant for vaporizing the liquid gas

Referring now to the drawings, wherein like reference numerals designate identical or corresponding parts throughout the several views, the plant for treating a deep-frozen liquid gas 1 mainly comprises a main evaporator/air cooler 4 which is connected to a supply tank 3 by means of a main liquid-gas line 2. Adjoining the latter on the downstream side is a main gas line 5 which connects the treatment plant to a downstream plant 6 (FIG. 1). This downstream plant 6 has a technical process, in which the deep-frozen liquid gas 1 is used as fuel or otherwise in a physical and/or chemical process, and in which, at the same time, there is a requirement for process cooling. For example, a gas turbine plant (FIG. 2) or even a plant of the steel or chemical industry (not illustrated) may be connected to the treatment plant. Of course, a plurality of supply tanks 3 may also be connected to the plant 6 via a common treatment plant.

Arranged inside the supply tank 3 is a delivery pump 7 and, in the main liquid-gas line 2, a high-pressure feed pump 8 outside the supply tank 3. A nonreturn valve 9 is disposed between the two pumps 7, 8. Downstream of the high-pressure feed pump 8, a return flow line 10 branches off from the main liquid-gas line 2 to the supply tank 3. A throttle plate 11 and a check valve 12 are arranged in the return flow line 10 (FIG. 1).

Further downstream, a first and a second subline 13, 14 branch off from the main liquid-gas line 2. Disposed one after another in the first subline 13 are a shutoff valve 15, an auxiliary evaporator 17 connected to a cooling circuit 16, a pressure control valve 18 and a burner 19. The burner 19 is a component of an overflow evaporator 20 which is arranged in the second subline 14, a shutoff valve 21 being connected upstream and a check valve 22 being connected downstream of it. The latter is disposed in an auxiliary gas line 23 which is connected to the overflow evaporator 20 downstream and opens with its other end into the main gas line 5.

A further shutoff valve 24, 25 is arranged respectively in the main liquid-gas line 2 and in the main gas line 5 both between the bifurcation of the two sublines 13, 14 and the main evaporator/air cooler 4 and between the latter and the joining of the auxiliary gas line 23. Moreover, the main gas line 5 has a pressure control valve 26 upstream of the plant 6. An intake line 27 for a first heat-exchange medium 28, likewise connected to the plant 6, is arranged so as to intersect the main liquid-gas line 2 in the main evaporator/air cooler 4. In this case, ambient air is used as the first heat-exchange medium 28. Of course, instead of using the cross-flow principle, the heat exchange can also be implemented by means of a different heat-exchange principle, for example the principle of counterflow or parallel flow, or in wrapped heat exchangers (not illustrated).

Stored in the supply tank 3 is liquefied natural gas (LNG) used as the deep-frozen liquid gas 1 and delivered, for example, by refrigeration tankers. In normal operation of the plant 6 connected to the treatment plant, the shutoff valves 24, 25 arranged in the main liquid-gas line 2 and in the main gas line 5 are open, and the shutoff valves 15, 21 of the sublines 13, 14 are closed.

The liquefied natural gas (LNG) 1 stored under atmospheric pressure in the supply tank 3 is delivered into the main liquid-gas line 2 with the aid of the delivery pump 7. The high-pressure feed pump 8 arranged there raises the pressure to the required operating pressure and conducts the liquefied natural gas 1 on to the main evaporator/air cooler 4 at said operating pressure. In the process, the nonreturn valve 9 arranged between the two pumps 7, 8 prevents the liquefied natural gas 1 from flowing back into the supply tank 3 via the main liquid-gas line 2. The unused quantity of liquefied natural gas 1 is fed back to the supply tank 3 via the return flow line 10. The throttle plate 11 arranged there brings about a reduction in pressure of the minimum quantity of deep-frozen liquefied natural gas 1 constantly flowing back, starting from the pressure level downstream of the high-pressure feed pump 8, to the pressure level required for safe return flow into the supply tank 3. With the high-pressure feed pump 8 switched off, the check valve 12 prevents the deep-frozen liquefied natural gas 1 from flowing back from the return flow line 10 into the main liquid-gas line 2.

Direct heat exchange between the liquefied natural gas 1 and ambient air 28 prevailing in the intake line 27 takes place in the main evaporator/air cooler 4. In the process, the evaporation energy required for the regasification of the liquefied natural gas 1 is recovered by means of heat exchange between the ambient air 28 sucked in and the liquefied natural gas 1. As a result thereof, on the one hand, a gaseous fuel 29 is produced, in this case natural gas, which is burnt in the plant 6. In this case, a gas pressure corresponding to the requirements of the plant 6 is set by means of the pressure reducing valve 26. On the other hand, the ambient air 28 sucked in is cooled down, thus enabling the cooling requirement of the downstream plant 6 to be satisfied. The ambient air 28, which serves as the working medium of the downstream plant 6 and is sucked in by the latter, is thus, at the same time, the first heat-exchange medium of the treatment plant, and the air cooler 4 becomes its main evaporator.

When the plant 6 connected to the treatment plant is started up, it immediately requires sufficient gaseous fuel 29. At this point in time, however, there is not yet any ambient air 28, which has been sucked in, available in the main evaporator/air cooler 4 for the regasification of the deep-frozen liquid gas 1 prevailing in the main liquid-gas line 2. The shutoff valves 24, 25 are therefore initially closed, as a result of which the main evaporator/air cooler 4 is disconnected from the treatment plant. At the same time, the shutoff valves 15, 21 arranged in the two sublines 13, 14 are opened. A first part-flow 30 of the liquefied natural gas 1 flows into the subline 13 and is regasified in the auxiliary evaporator 17 to form a gaseous fuel 29' under the effect of an external heat-exchange medium 31 circulating in the cooling circuit 16. In this case, a gas pressure corresponding to the requirements of the burner 19 is set by means of the pressure reducing valve 18. Seawater is used as the external heat-exchange medium 31, although other suitable media may, of course, also be used.

When the gaseous fuel 29' has flowed into the burner 19, the latter is ignited, thus producing hot smoke gases 32 in the overflow evaporator 20. This additional and internal heat-exchange medium 32 serves to regasify a second part-flow 33 of the liquefied natural gas 1 fed in via the second subline 14. The gaseous fuel 29" obtained in the process is fed into the main gas line 5 via the auxiliary gas line 23 and is thus available to the downstream plant 6. The gaseous fuel 29" is prevented from flowing back into the overflow evaporator 20 by the check valve 22. When the plant 6 has started up and has taken in sufficient ambient air 28, the main evaporator/air cooler 4 is connected up to the treatment plant. This takes place by opening the previously closed shutoff valves 24, 25 and, at the same time, closing the shutoff valves 15, 21 arranged in the two sublines 13, 14.

In the event of a failure, or even a scheduled repair, of the plant 6, the main evaporator/air cooler 4 is not operational. In this case, as already described above, the treatment plant is switched over to the overflow evaporator 20, and the gaseous fuel 29" produced there is fed to an external user (not illustrated) via a gas line 34 illustrated by dashes in FIG. 1. Instead of the overflow evaporator 20, a different suitable auxiliary evaporator may, of course, also be used.

Figures 2, 3:
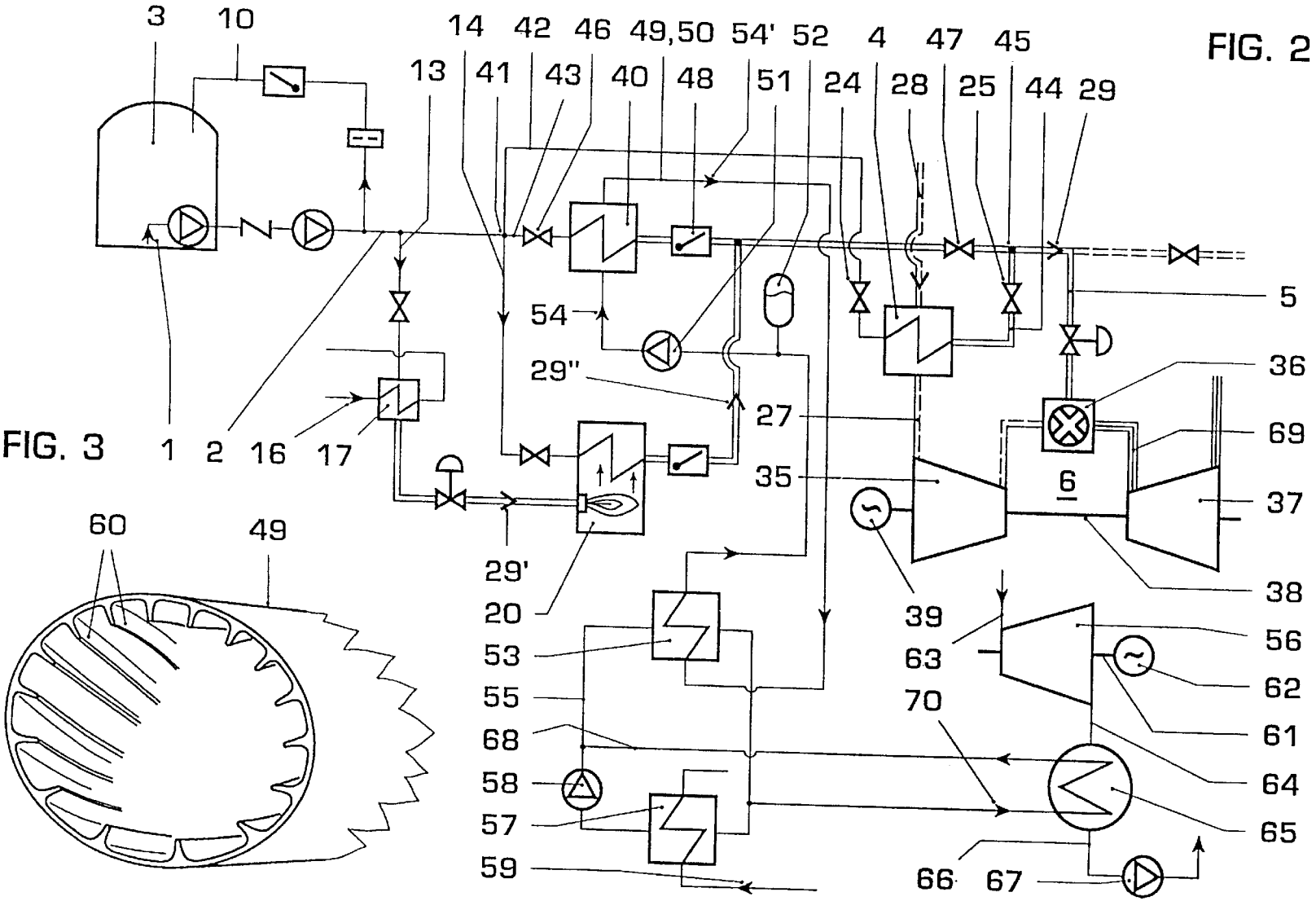
FIG. 2 shows an illustration corresponding to FIG. 1, in which the treatment plant is connected both to a gas turbine plant and to a steam turbine.
FIG. 3 shows a front view of a cross-sectional pipe of the closed cooling water system of the treatment plant.

In a first exemplary embodiment of the invention, the plant 6 downstream of the treatment plant is configured as a gas turbine plant, with a compressor 35, a combustion chamber 36 and a gas turbine 37. Accordingly, the main gas line 5 connected to the main evaporator/air cooler 4 is connected downstream to the combustion chamber 36, while the intake line 27 for the ambient air 28 opens into the compressor 35. The gas turbine 37 and the compressor 35 are mounted on a common shaft 38 which, at the same time, also accommodates a generator 39 (FIG. 2).

In addition, the treatment plant has a second evaporator 40 arranged in the main gas line 5 parallel to the main evaporator/air cooler 4. For this purpose, the main liquid-gas line 2 branches into two liquid-gas sublines 42, 43 at a bifurcation point 41 disposed upstream of the second evaporator 40. The main evaporator/air cooler 4 is arranged essentially as already described above in the first liquid-gas subline 42. Differing from the above, it has, on the outlet side, an intermediate line 44 to a joining point 45 into the main gas line 5 connected on the outlet side of the second evaporator 40. The shutoff valve 24 of the main evaporator/air cooler 4 is disposed in the first liquid-gas subline 42, and the shutoff valve 25 is disposed in the intermediate line 44. The second liquid-gas subline 43 accommodates the second evaporator 40, a shutoff valve 46 being arranged between the latter and the bifurcation point 41. A further shutoff valve 47 is disposed in the main gas line 5 between the second evaporator 40 and the joining point 45 of the intermediate line 44. Moreover, the main gas line 5 has a check valve 48 in the region between the second evaporator 40 and the shutoff valve 47.

The second evaporator 40 is arranged in a closed cooling water system 50 which consists of pipes 49 and accommodates a recirculation pump 51, a high-level tank 52 and a second cooler 53 for a second heat-exchange medium 54. Said second cooler 53 is a component of a main cooling circuit 55 of a steam turbine 56 connected to the gas turbine plant 6. The main cooling circuit 55 is fitted with a main cooler 57 and with a main cooling-water pump 58. It is connected via the main cooler 57 to a cooling source 59, in which case a cooling tower, an air cooling system or even seawater or river water can be used as said source. The pipes 49 of the closed cooling water system 50 are provided, on the inside, with a plurality of spirally formed ribs 60 (FIG. 3).

The steam turbine 56 seated on a common shaft 61 with a generator 62 is connected both on the steam inlet side via a live steam line 63 and on the steam outlet side via a waste steam line 64 to a water/steam circuit (not illustrated) and via the latter to the gas turbine 37. Arranged in the waste steam line 64 is a condenser 65 to which a water line 66 with an integrated condensate pump 67 is connected downstream. The condenser 65 has a cooling circuit 68 which opens into the main cooling circuit 55 and branches off from the latter (FIG. 2).

When the gas turbine plant 6 and the steam turbine 56 are in operation, the liquefied natural gas (LNG) 1 stored in the supply tank 3 is regasified in the treatment plant to form a gaseous fuel 29, i.e. to form natural gas. The natural gas 29 is burnt in the combustion chamber 36 of the gas turbine plant 6. In the process, smoke gases 69 are produced, which are expanded in the gas turbine 37 and serve to drive both said gas turbine and, via the shaft 38, to drive the compressor 35 and the generator 39. Subsequently, the waste turbine gases are converted to live steam in a water/steam circuit (not illustrated) with the aid of known methods. The live steam conducted on via the live steam line 63 to the steam turbine 56 is expanded in the latter and thus drives the generator 62. In the condenser 65, the waste steam from the steam turbine 56 is condensed, and the water produced is recirculated in the water/steam circuit.

The liquefied natural gas 1 is regasified by means of a direct heat exchange with the ambient air 28, sucked in by the compressor 35, in the main evaporator/air cooler 4 of the treatment plant. In the process, the energy required for the evaporation is recovered by means of the cooling of the sucked-in ambient air 28 by means of the liquefied natural gas 1. The use of the significantly cooled-down ambient air 28 as the working medium of the compressor 35 improves its effectiveness and that of the entire gas turbine plant 6. The ambient air 28 is thus, at the same time, the first heat-exchange medium of the treatment plant, and the air cooler 2 becomes its main evaporator.

The energy available from the sucked-in ambient air 28 to vaporize the liquefied natural gas 1 fluctuates depending on the time of year. Added to this is the fact that, at a low temperature of the ambient air 28 sucked in, as is usually the case in winter, it is not necessary to cool it. Accordingly, the required evaporation energy is taken from the main cooling circuit 55 under appropriate operating conditions. Depending on the requirement, the evaporation of the liquefied natural gas 1 can proceed both in the main evaporator/air cooler 4 and in the second evaporator 40, or even only in one of the two. If, however, the refrigerating potential of the liquefied natural gas 1 cannot be used fully by the refrigerating capacity of the first heat-exchange medium 28, both evaporation operations are used simultaneously.

In this case, a second heat exchange of the liquefied natural gas 1 with a second heat-exchange medium 54 takes place in the evaporator 40 in parallel with the first heat exchange taking place in the main evaporator/air cooler 4. For this purpose, the recirculation pump 51 delivers water stored in the high-level tank 52 as the second heat-exchange medium 54 to the main cooling circuit 55 and subsequently back to the evaporator 40. In addition to storing the water 54, the high-level tank 52 also serves to control the intake pressure of the recirculation pump 51 and additionally as a level compensation container. During the heat exchange with the deep-frozen liquefied natural gas 1, the temperature of the water 54 is lowered to virtually 0° C. and, as a result, some of the water 54 is converted to ice, so that there is ice water 541 in the closed cooling water system 50 downstream of the evaporator 40.

The helical ribs 60 produce a turbulent flow of the ice water 54' in the pipes 49 of the closed cooling water system 50, so that no ice can settle inside the pipes 49 (FIG. 3). Of course, this effect can also be enhanced by other passive means, such as for example corresponding inserts or non-stick coatings, or by active means, e.g. rotating vortex generators (not illustrated). This ice water 54' enables the cooling medium 70 of the condenser 65 to be cooled effectively.

As an alternative or even in addition to the measures described above, additives (e.g. various minerals) are added to the water 54. This allows the temperature of the ice water 54' produced during the heat exchange with the liquefied natural gas 1 to drop considerably below 0° C. without the risk of the tubes 49 becoming iced. In this way, a far greater proportion of the refrigerating potential of the liquefied natural gas 1 can be used for cooling the downstream process.

The main cooler 57 and the cooling source 59 have the same function as the second cooler 53. They are used whenever the refrigerating potential of the liquefied natural gas 1 is not sufficient for the required cooling purposes or when the treatment plant for the liquefied natural gas 1 is not in operation, but there is nevertheless a requirement for cooling.

Of course, the second evaporator 40 may also be connected via the closed cooling water system 50 to other users, for example to the water/steam circuit of the steam turbine 56 (not illustrated). The refrigerating potential of the liquefied natural gas 1 can thus be used even more efficiently. Moreover, various switching possibilities result, which increase the variability of the plant.

Figure 4:
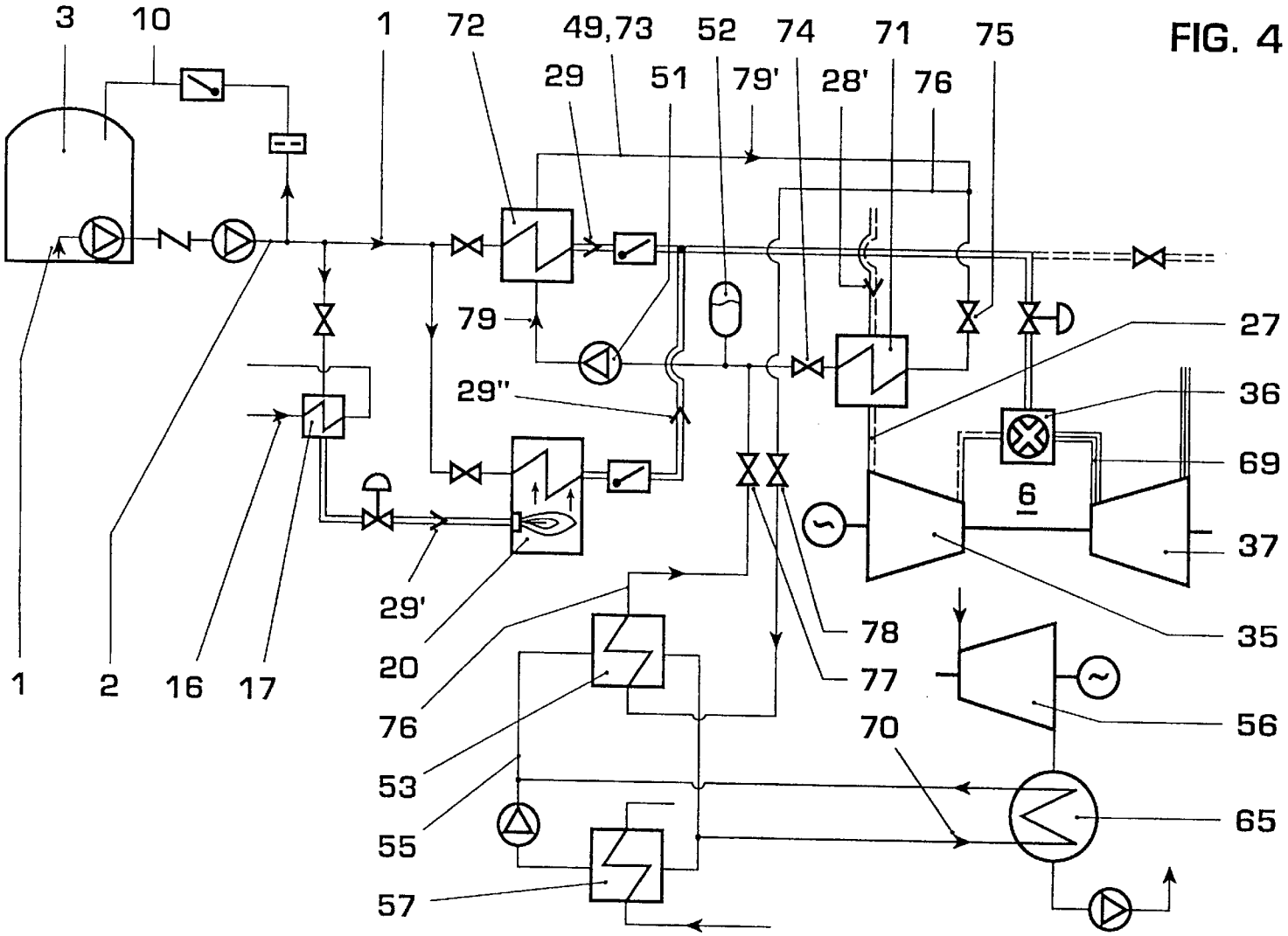
FIG. 4 shows an illustration according to FIG. 2, but corresponding to a second exemplary embodiment.

In a second exemplary embodiment, the plant 6 downstream of the treatment plant is likewise configured as a gas turbine plant which interacts with a steam turbine 56. The compressor 35 is concerted to an air cooler 71 by means of the intake line 27. A main evaporator 72 for the liquefied natural gas 1 is arranged in the main liquid-gas line 2. The main evaporator 72 is a component of a cooling circuit 73 in which, apart from the high-level tank 52 and the recirculaton pump 51, the air cooler 71 of the compressor 35 of the gas turbine plant 6 is also arranged in series. Disposed downstream of the air cooler 71 in the cooling circuit 73 is a shutoff valve 74 and, upstream of the air cooler 71, a control valve 75 (FIG. 4). Arranged parallel to the cooling circuit 73 is a closed cooling water system 76 which connects the cooling circuit 73 to the main cooling circuit 55 configured analogously to the first exemplary embodiment. The closed cooling water system 76 has two shutoff valves 77, 78, to which the treatment plant can be connected or disconnected, depending on the specific operating situation of the main cooling circuit 55.

As in the first exemplary embodiment, with the ambient air 28' sucked in by the compressor 35, a working medium of the process following the regasification of the liquefied natural gas 1 is used as a heat sink of said downstream process. However, the ambient air 28' is cooled beforehand in the heat exchange with a first heat-exchange medium 79 and, following this heat exchange, the latter is recirculated for the heat exchange with the deep-frozen liquefied natural gas 1. Water is used as the first heat-exchange medium 79, which is partially converted to ice during the heat exchange with the deep-frozen liquefied natural gas 1 in analogy to the first exemplary embodiment. Accordingly, there is ice water 79' in the cooling circuit 73 downstream of the main evaporator 72. By means of the helical ribs 60, vortices are likewise generated in the pipes 49 of the cooling circuit 73, which vortices ensure that the ice water 79' remains free-flowing and prevents icing of the pipes 49 (FIG. 3). Depending on the requirement for cooling of the plant and on the refrigerating potential of the liquefied natural gas 1, effective cooling both of the ambient air and of the cooling medium 70 of the condenser 65 is made possible. In addition, besides the main evaporator 72, either the air cooler 71 and/or the closed cooling water system 76 can be operated selectively by appropriate closing and opening of the valves 74, 75 and the shutoff valves 77, 78 (FIG. 4).

The gaseous fuel 29 recovered during the regasification is likewise fed to the combustion chamber 36, is burnt there to form a smoke gas 69, and the latter is expanded in the gas turbine 37 for the purpose of the power output. All further steps of the method proceed in analogy to the first exemplary embodiment.

Obviously, numerous modifications and variations of the present invention are possible in light of the above teachings. It is therefore to be understood that within the scope of the appended claims, the invention may be practiced otherwise than as specifically described herein.

We claim:

1. A method for preparing deep-frozen liquid gas for a downstream technical process which is carried out in several part-steps and in which the deep-frozen liquid gas is regasified in a heat exchange with at least one heat-exchange medium before it is used in the downstream process, wherein a refrigerating capacity of the deep-frozen liquid gas is fed as a heat sink to at least one of the part-steps of the downstream process via at least one heat-exchange medium, regasifying the deep-frozen liquid gas with an additional heat-exchange medium when said heat exchange medium is not available, cooling a first heat-exchange medium in the direct heat exchange with the deep-frozen liquid gas wherein a working medium of the downstream process is used as the first heat-exchange medium, and in addition to a first one, a second heat exchange of the deep-frozen liquid gas takes place with a second heat-exchange medium, and subsequently each heat-exchange medium is fed to a separate part-step of the downstream process, wherein water is used as the second heat-exchange medium, the temperature of said water is lowered to virtually 0° C. in the heat exchange with the deep-frozen liquid gas, and in the process the water being converted to ice water and, at the same time, a turbulent flow being generated in the ice water.

2. The method as claimed in claim 1, wherein the deep-frozen liquid gas is firstly subdivided into two part-flows, the first part-flow is regasified by means of an external heat-exchange medium, is then ignited and burnt with formation of the additional heat-exchange medium, while the second part-flow of the deep-frozen liquid gas is regasified in the heat exchange with the additional heat-exchange medium.

3. The method as claimed in claim 1, wherein the deep-frozen liquid gas is regasified to form a gaseous fuel, said gaseous fuel is fed to a gas turbine process, is burnt there to form a smoke gas and the latter is expanded for the purpose of work output, ambient air to be compressed in the gas turbine process being used as the first heat-exchange medium, and the second heat-exchange medium being used as a heat sink of a steam turbine process connected to the gas turbine process.

4. The method as claimed in claim 1, wherein an additive is added to the water, and the temperature of said water is lowered further in the heat exchange with the deep-frozen liquid gas.

5. A method for preparing deep-frozen liquid gas for a downstream technical process which is carried out in several part-steps and in which the deep-frozen liquid gas is regasified in a heat exchange with at least one heat-exchange medium before it is used in the downstream process, wherein a refrigerating capacity of the deep-frozen liquid gas is fed as a heat sink to at least one of the part-steps of the downstream process via at least one heat-exchange medium and, the deep-frozen liquid gas being regasified with an additional heat-exchange medium when the heat-exchange medium is not available, the deep-frozen liquid gas being firstly subdivided into two part-flows, the first part-flow being regasified by means of an external heat-exchange medium, being then ignited and burnt with formation of the additional heat-exchange medium, while the second part-flow of the deep-frozen liquid gas being regasified in the heat exchange with the additional heat-exchange medium, wherein a working medium of the downstream process is used as the heat sink of the at least one part-step of the downstream process, said working medium being cooled beforehand in the heat exchange with a first heat-exchange medium and, after said heat exchange, the latter being recirculated for heat exchange with the deep-frozen liquid gas.

6. The method as claimed in claim 5, wherein the deep-frozen liquid gas is regasified to form a gaseous fuel, said gaseous fuel is fed to a gas turbine process, is burnt there to form a smoke gas and the latter is expanded for the purpose of work output, ambient air to be compressed in the gas turbine process being used as the working medium cooled by the first heat-exchange medium.

7. The method as claimed in claim 5, wherein water is used as the first heat-exchange medium, the temperature of said water is lowered to virtually 0° C. in the heat exchange with the deep-frozen liquid gas, and in the process the water being converted to ice water and, at the same time, a turbulent flow being generated in the ice water.

8. The method as claimed in claim 11, wherein an additive is added to the water, and the temperature of said water is lowered further in the heat exchange with the deep-frozen liquid gas.

* * * * *